US010364081B1

(12) United States Patent
Lai

(10) Patent No.: US 10,364,081 B1
(45) Date of Patent: Jul. 30, 2019

(54) TOOL HANGER

(71) Applicant: Jin-Lan Lai, Taichung (TW)

(72) Inventor: Jin-Lan Lai, Taichung (TW)

( * ) Notice: Subject to any disclaimer, the term of this patent is extended or adjusted under 35 U.S.C. 154(b) by 0 days.

(21) Appl. No.: 15/983,742

(22) Filed: May 18, 2018

(51) Int. Cl.

| | |
|---|---|
| ***B25H 3/00*** | (2006.01) |
| ***B65D 73/00*** | (2006.01) |
| ***B25H 3/02*** | (2006.01) |
| ***B25H 3/04*** | (2006.01) |

(52) U.S. Cl.
CPC ..... *B65D 73/005* (2013.01); *B25H 3/003* (2013.01); *B25H 3/02* (2013.01); *B25H 3/04* (2013.01)

(58) Field of Classification Search
USPC ..... 206/378, 376, 373, 372
See application file for complete search history.

(56) References Cited

U.S. PATENT DOCUMENTS 6,092,656 A * 7/2000 Ernst ..... B25H 3/06 206/378
6,742,653 B2 * 6/2004 Kao ..... A47F 5/0861 206/373
2003/0141211 A1 * 7/2003 Tsai ..... B25H 3/003 206/378
2005/0241974 A1 * 11/2005 Chen ..... B25H 3/003 206/379
2006/0070902 A1 * 4/2006 Tuan-Mu ..... B25H 3/003 206/378
2010/0032327 A1 * 2/2010 Lai ..... B25H 3/003 206/375
2016/0136791 A1 * 5/2016 Ou ..... B25H 3/003 206/377

FOREIGN PATENT DOCUMENTS

TW 317229 U 10/1997

* cited by examiner

*Primary Examiner* — Jacob K Ackun
(74) *Attorney, Agent, or Firm* — Muncy, Geissler, Olds & Lowe, P.C.

(57) ABSTRACT

A tool hanger is provided, including a main body, having a notch, two first pivot portions and at least one first connection portion; a base, detachably connected with the notch, the base having two second pivot portions, one of the first pivot portion and the second pivot portion including a pivot groove and the other including a pivot portion which is pivotally connected with the pivot groove, a direction about which the pivot portion rotates being defined as an axial direction, the pivot portion having a first outer diameter which is transverse to the axial direction and a second outer diameter which is transverse to the axial direction, the first outer diameter being sized greater than an opening span of the pivot groove, the second outer diameter being sized less than or equal to the opening span of the pivot groove.

10 Claims, 6 Drawing Sheets

TOOL HANGER

BACKGROUND OF THE INVENTION

Field of the Invention

The present invention relates to a tool hanger.

Description of the Prior Art

A tool hanger is for displaying sockets which respectively assemble to a hand tool. A conventional tool hanger, as shown in TW 317229, includes a main body, a plurality of seat bases and a cover. The cover covers the main body, each seat bases is for assembling the sockets. Each seat bases is disposed pivotally to the main body and disposed between the main body and cover.

The conventional tool hanger prevents the sockets from being theft and disengaging from the main body in a manner of restricting between the cover and the main body. The main body has two concaves, and each seat bases has two pivot columns which are respectively disposed pivotally within the two concaves, so that each seat bases can be directly assembled and disassembled to the main body. However, each seat bases can be rotated relative to the base, but there is no positioning limited structure disposed between the main body and each seat bases. Each seat bases is easy to disengage from the main body, so that it is inconvenient to use. Thus, the conventional tool hanger must need the cover to prevent each seat bases from disengaging from the main base. Therefore, a structure of the conventional tool hanger is complex.

Besides, each bases and the main body are connected pivotally with each other by pivot rods and pivot grooves generally. Each pivot grooves of the conventional tool hanger has a throat opening to clamp each pivot rods and restrict each pivot rods within each pivot grooves, so as to prevent each pivot rods from easily disengaging from the main base. However, a structure of the throat opening of each pivot grooves is not easy to produce and hard to mold.

The present invention is, therefore, arisen to obviate or at least mitigate the above mentioned disadvantages.

SUMMARY OF THE INVENTION

An object of the present invention is to provide a tool hanger, which is provided to assemble a base to a main body with a tilt angle in a simple structure to achieve rotation, position limitation and anti-proof effect.

To achieve the above and other objects, a tool hanger is provided, including: a main body, having a notch, two first pivot portions which are disposed on two opposite sides of the notch and at least one first connection portion; a base, detachably connected with the notch, the base having two second pivot portions at two opposite sides thereof and at least one second connection portion which corresponds to and is detachably connected with the at least one first connection portion, one of the first pivot portion and the second pivot portion including a pivot groove and the other including a pivot portion which is pivotally connected with the pivot groove, a direction about which the pivot portion rotates being defined as an axial direction, the pivot portion having a first outer diameter which is transverse to the axial direction and a second outer diameter which is transverse to the axial direction, the first outer diameter being sized greater than an opening span of the pivot groove, the second outer diameter being sized less than or equal to the opening span of the pivot groove.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
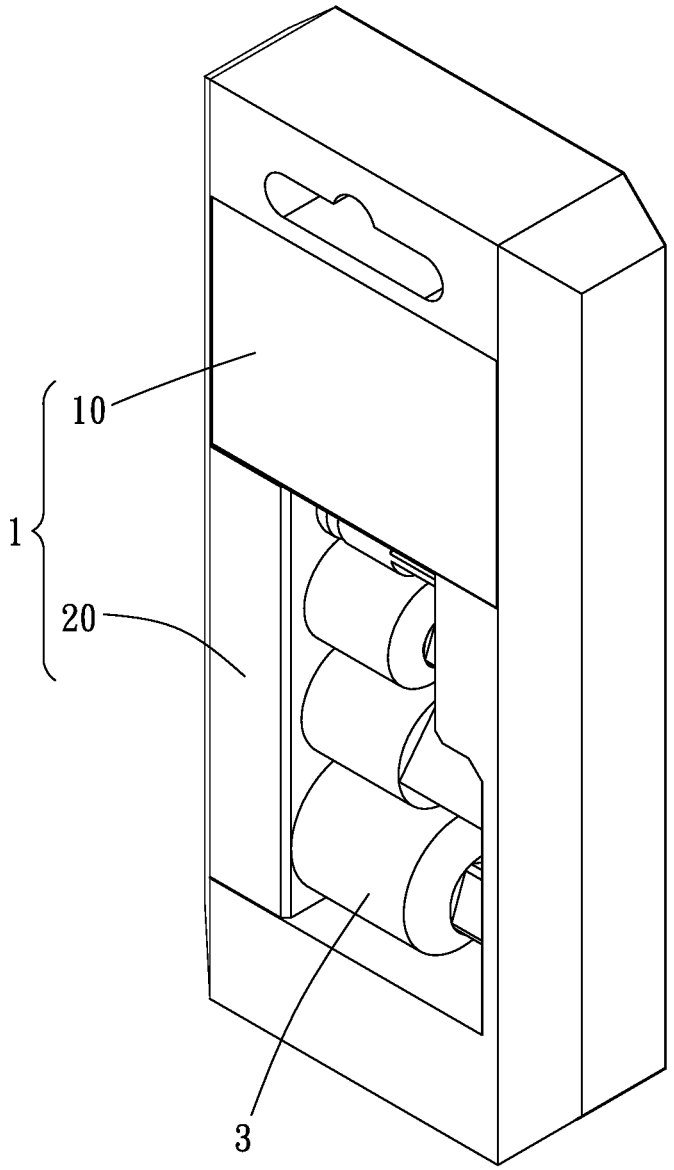
FIG. 1 is a perspective view of a tool hanger according to a preferred embodiment of the present invention.
Figure 2:
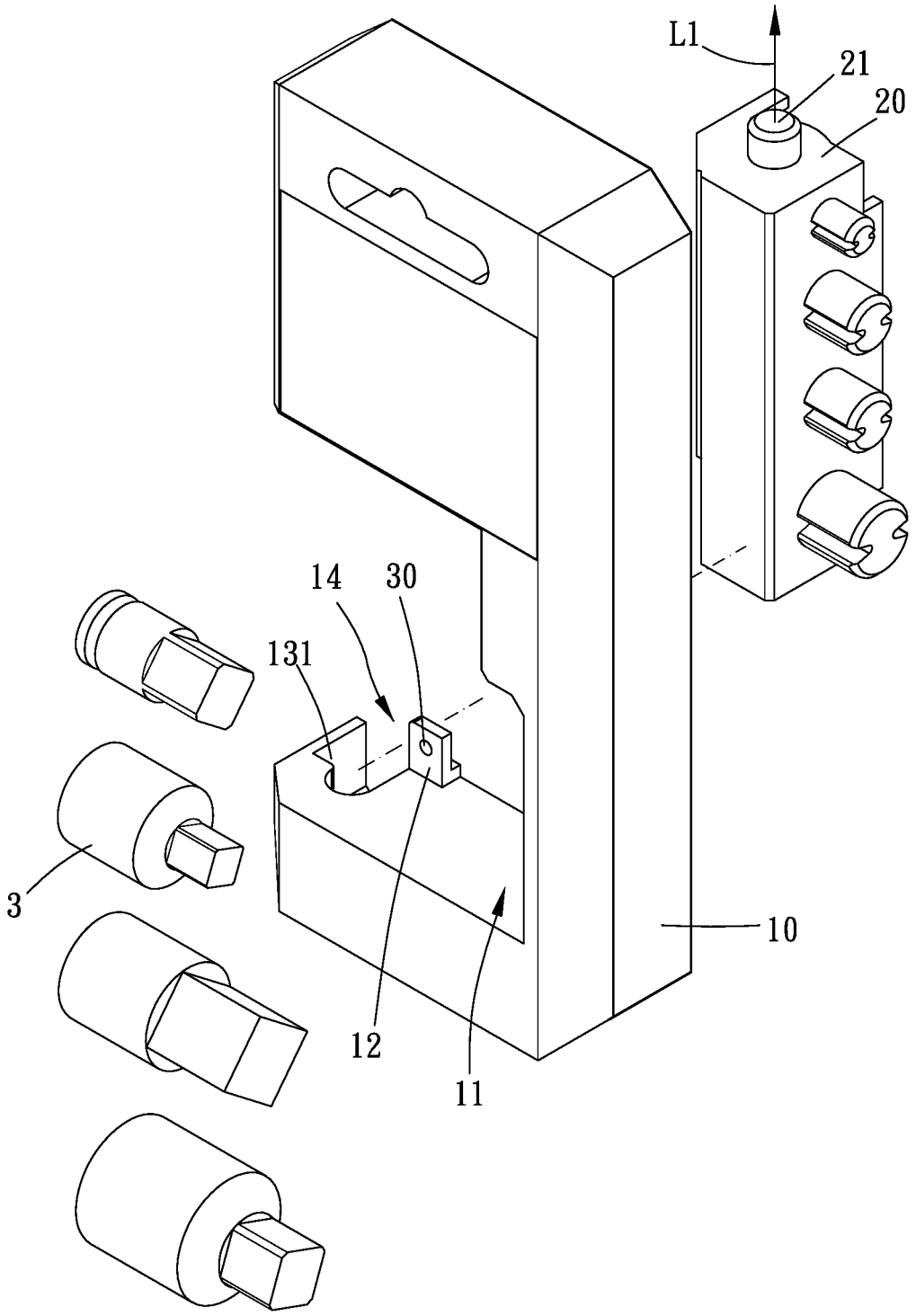
FIG. 2 is a breakdown drawing of a preferable embodiment of the present invention.
Figure 3:
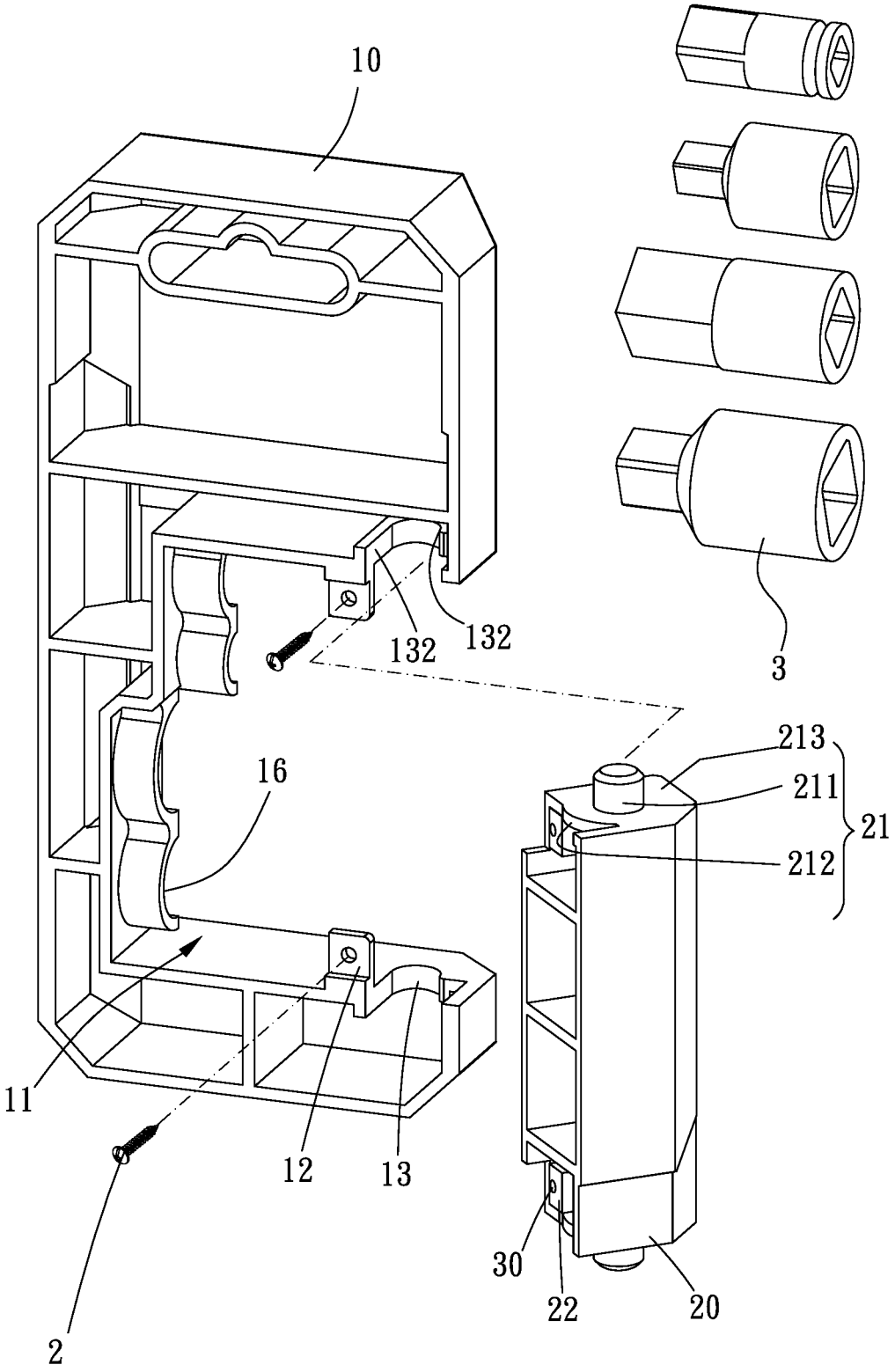
FIG. 3 is another breakdown drawing of the preferable embodiment of the present invention.
Figure 4:
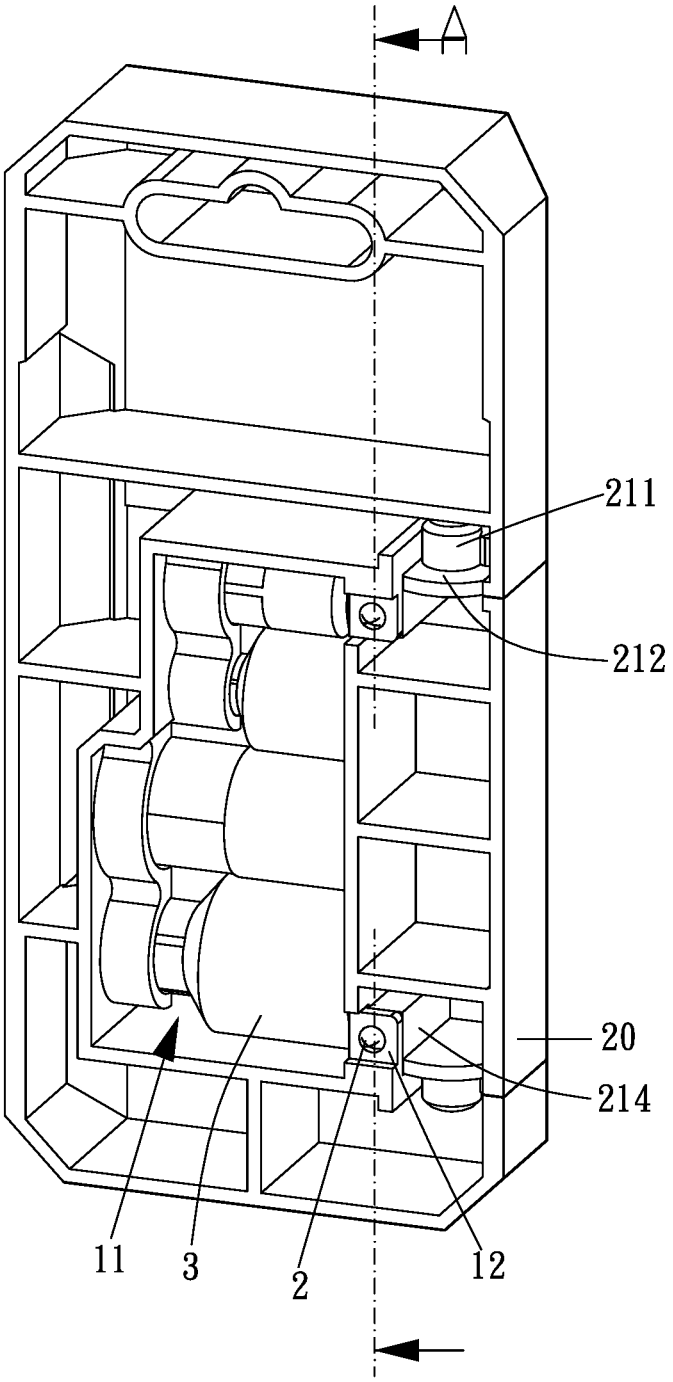
FIG. 4 is another perspective view of the preferable embodiment of the present invention.
Figure 5:
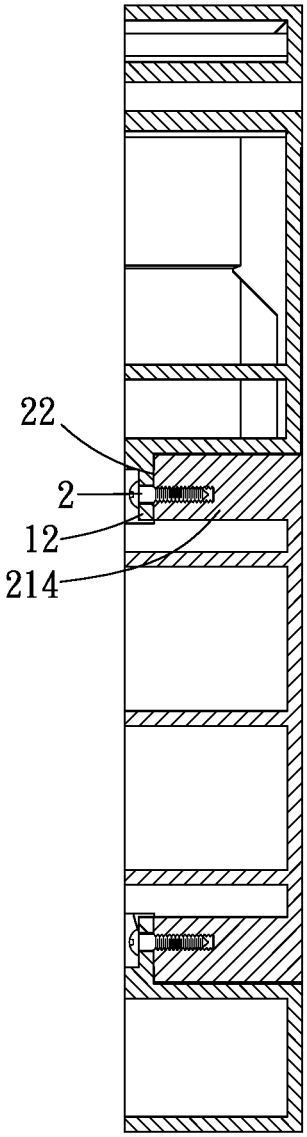
FIG. 5 is a cross-sectional view of line A-A of FIG. 4.
Figure 6:
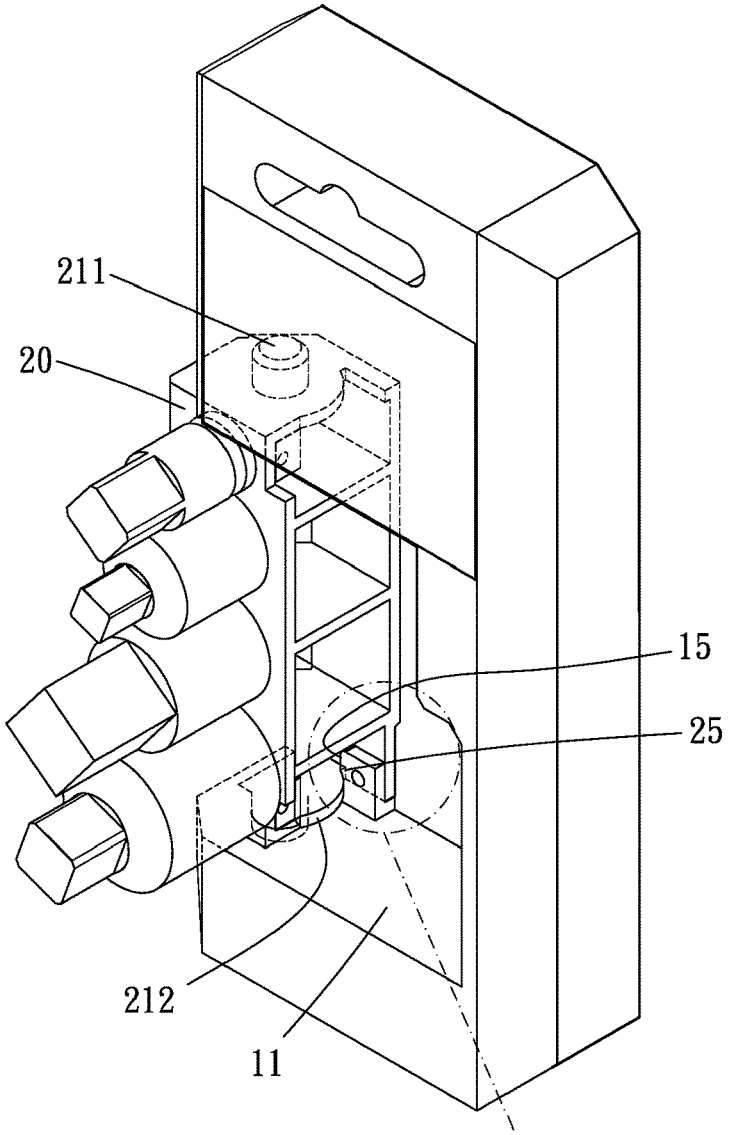
FIG. 6 is a drawing showing the preferred embodiment of the present invention in use.
Figure 7:
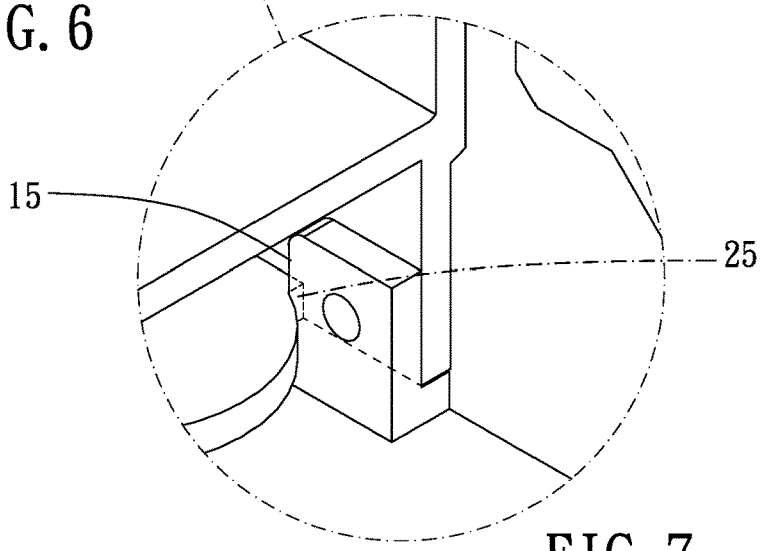
FIG. 7 is a partial-enlarged view of FIG. 6.
Figure 8:
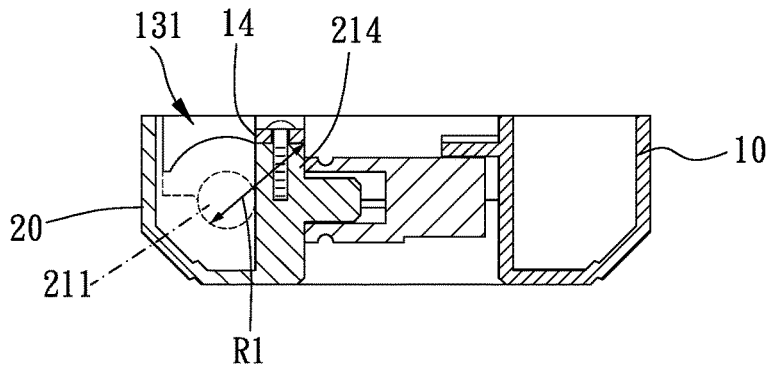
FIGS. 8 to 10 are a cross-sectional view of the preferable embodiment of the present invention.
Figure 9:
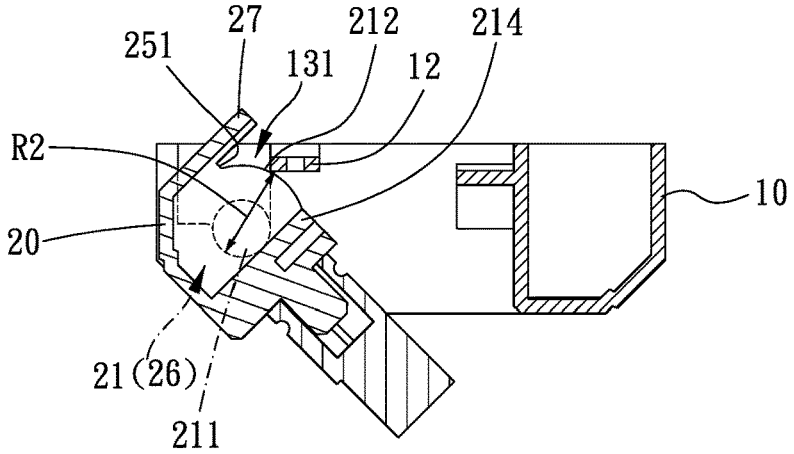

FIGS. 1 to 10 show a tool hanger 1 according to a preferred embodiment of the present invention. The tool hanger 1 includes a main body 10 and a base 20.

The main body 10 has a notch 11, two first pivot portions 13 which are disposed on two opposite sides of the notch 11 and at least one first connection portion 12. The base 20 is detachably connected with notch 11, the base 20 has two second pivot portions 21 at two opposite sides thereof and at least one second connection portion 22 which corresponds to and is detachably connected with the at least one first connection portion 12. One of the first pivot portion 13 and the second pivot portion 21 includes a pivot groove and the other includes a pivot portion which is pivotally connected with the pivot groove. A direction about which the pivot portion rotates is defined as an axial direction L1. In this embodiment, each of the two first pivot portions 13 includes one said pivot groove 131, and each of the two second pivot portions 21 includes one said pivot portion 26. The pivot portion 26 has a first outer diameter R1 which is transverse to the axial direction L1 and a second outer diameter R2 which is transverse to the axial direction L1. The first outer diameter R1 is sized greater than an opening span 14 of the pivot groove 131, and the second outer diameter R2 is sized less than or equal to the pivot groove 131 the opening span 14 of the pivot groove 131. The present invention has a simple structure to assemble and disassemble the base 20 directly to the main body 10 with a tilt angle. Therefore, the base 20 is rotatable relatively to the main body 10, restricted in predetermined positions and also provided an anti-proof effect. Preferably, each of the first connection portion 12 and the second connection portion 22 has a threaded structure 30 which is adapted for a screw member 2 to screw within. The threaded structure 30 can be a screwed hole or through hole; in other embodiment, each of the first connection portion 12 and the second connection portion 22 can be a locking mechanism. The present invention provides anti-proof effect and re-use by assembling and disassembling the screw member 2 to the first connection portion 12 and the second connection portion 22. In this embodiment, one said pivot groove 131 and a circumferential periphery of the at least one first connection portion 12 are formed the opening span 14, so as to easy manufacture and provide the simple structure.

In this embodiment, each of the at least one first connection portion 12 is adjacent to the pivot groove 131, each of the at least one second connection portion 22 is disposed on one said pivot portion 26, so that each second connection portion 22 can be smoothly connected with each first connection portion 12 through the simple structure. Preferably, the pivot groove 131 has two lateral end faces 132 which face each other and are disposed in parallel. Therefore, it is easy for molding and connecting the pivot portion 26 within the pivot groove 131.

In this embodiment, the pivot portion 26 further includes a base board 213 and a pivot rod 211 which is disposed on the base board 213 and extends along the axial direction L1. The base board 213 includes a protruding portion 214 transverse to the axial direction L1, and the first outer diameter R1 is defined diametrically from an outer circumference of the pivot rod 211 to a point on a circumferential periphery of the protruding portion 214, so that the base 20 can only be attached and detached with a tilt angle to the main body 10. Besides, the protruding portion 214 further includes an arc convex portion 212 which extends radially, and the second outer diameter R2 is defined diametrically from the outer circumference of the pivot rod 211 to another point on the circumferential periphery of the arc convex portion 212, so as to restrict the positions of the base 20 with the simple structure. Specifically, the base board 213, the arc convex portion 212 and the protruding portion 214 are integrally formed in one piece to easy produce and strong a structural strength.

Besides, a number of the at least one first connection portion 12 is two, the two first connection portions 12 are respectively disposed on two opposite sides of the notch 11; a number of the at least one second connection portion 22 is two, each of the second connection portions 22 is arranged on one said protruding portion 214, so that each of the second connection portions 22 can be connected with one of the two first connection portions 12 through rotating the pivot portion 26. In other embodiment, the number of the first connection portion 12 can be more than two, and the number of the second connection portion 22 corresponds to the number of the first connection portion 12. Besides, each first connection portions 12 can be a rod which is transverse across the notch 11.

It is to be noted that, a circumferential side of the at least one second pivot portion 21 includes a stop portion 25, and the at least one first connection portion 12 has a stop face 15 which corresponds to the stop portion 25 and is blockable with the stop portion 25, so as to limit a rotation angle of the base 20 relative to the main body 10. In this embodiment, the stop portion 25 has a concave 251 which extends in a circumferential direction, and the concave 251 is configured to receive the at least one first connection portion 12, so as to limit position stably.

Figure 10:
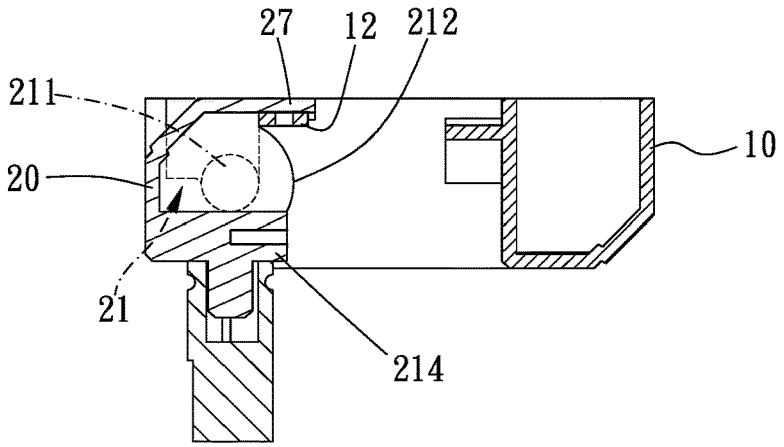

In this embodiment, the base 20 has a protrusion board 27 transverse to the axial direction L1, and the protrusion board 27 is abuttable against the at least one first connection portion 12, so as to limit position effectively. Specifically, as shown in FIG. 10, the protrusion board 27 abuts one said first connection portion 12 when the base 20 is perpendicular to the main body 10 but not limitation.

Besides, the main body 10 further includes a plurality of engagement grooves 16 which are communicated with the notch 11 and the plurality of engagement grooves 16 are different in size, so as to receive a variety sizes of sockets 3. In other embodiment, each of the engagement grooves can be a clamp structure instead.

In use, the base 20 is assembled and disassemble to the notch 11 of the main body 10 with a tilt angle, the base 20 is rotatable to the main body 10, and each first connection portions 12 and each second connection portions 22 can be abutted against each other; besides, when the second outer diameter R2 corresponds to the opening span 14, the base 20 can be detached from the main body 10; on the contrary, when the first outer diameter R1 corresponds to the opening span 14, the base 20 cannot be detached directly from the main body 10. Thus, the base 20 must be assembles and disassembles to the main body 10 with the tilt angle. Furthermore, the first and second connection portion 12, 22 can be detachably connected with each other to provide anti-proof effect and re-use.

Given above, the present invention can provide the simple structure to achieve position limitation, rotation, anti-proof and reuse effect.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A tool hanger, including:

a main body, having a notch, two first pivot portions which are disposed on two opposite sides of the notch and at least one first connection portion;

a base, detachably connected with the notch, the base having two second pivot portions at two opposite sides thereof and at least one second connection portion which corresponds to and is detachably connected with the at least one first connection portion, one of the first pivot portion and the second pivot portion including a pivot groove and the other including a pivot portion which is pivotally connected with the pivot groove, a direction about which the pivot portion rotates being defined as an axial direction, the pivot portion having a first outer diameter which is transverse to the axial direction and a second outer diameter which is transverse to the axial direction, the first outer diameter being sized greater than an opening span of the pivot groove, the second outer diameter being sized less than or equal to the opening span of the pivot groove.

2. The tool hanger of claim 1, wherein each of the two first pivot portions includes one said pivot groove, each of the at least one first connection portion is adjacent to one said pivot groove, each of the two second pivot portions includes one said pivot portion, and each of the at least one second connection portion is disposed on one said pivot portion.

3. The tool hanger of claim 1, wherein the pivot portion further includes a base board and a pivot rod which is disposed on the base board and extends along the axial direction, the base board includes a protruding portion transverse to the axial direction, and the first outer diameter is defined diametrically from an outer circumference of the pivot rod to a point on a circumferential periphery of the protruding portion.

4. The tool hanger of claim 3, wherein the protruding portion further includes an arc convex portion which extends radially, and the second outer diameter is defined diametrically from the outer circumference of the pivot rod to another point on the circumferential periphery of the arc convex portion.

5. The tool hanger of claim 1, wherein the pivot groove has two lateral end faces which face each other and are disposed in parallel.

6. The tool hanger of claim 1, wherein a circumferential side of the at least one second pivot portion includes a stop portion, and the at least one first connection portion has a stop face which corresponds to the stop portion and is blockable with the stop portion.

7. The tool hanger of claim 6, wherein the stop portion has a concave which extends in a circumferential direction, and the concave is configured to receive one said first connection portion.

8. The tool hanger of claim 1, wherein the main body further includes a plurality of engagement grooves which are communicated with the notch, and the plurality of engagement grooves are different in size.

9. The tool hanger of claim 1, wherein the base has a protrusion board transverse to the axial direction, and the protrusion board is abuttable against the at least one first connection portion.

10. The tool hanger of claim 4, wherein each of the two first pivot portions includes one said pivot groove, each of the at least one first connection portion is adjacent to one said pivot groove, each of the two second pivot portions includes one said pivot portion, and each of the at least one second connection portion is disposed on one said pivot portion; the pivot groove has two lateral end faces which face each other and are disposed in parallel; a circumferential side of the at least one second connection portion includes a stop portion, and the at least one first connection portion has a stop face which corresponds to the stop portion and is blockable with the stop portion; the stop portion has a concave which extends in a circumferential direction, the concave is configured to receive the at least one first connection portion; the main body further includes a plurality of engagement grooves which are communicated with the notch, and the plurality of engagement grooves are different in size; the base has a protrusion board transverse to the axial direction, the protrusion board is abuttable against the at least one first connection portion; a number of the at least one first connection portion is two, the two first connection portions are respectively disposed on two opposite sides of the notch; a number of the at least one second connection portion is two, and each of the two second connection portions is arranged on one said protruding portion; one said pivot groove and a circumferential periphery of the at least one first connection portion are formed the opening span; and each of the first connection portion and the second connection portion has a threaded structure which is adapted for a screw member to screw within.

* * * * *